United States Patent [19]

Tiberg

[11] 4,058,156

[45] Nov. 15, 1977

[54] DEVICE FOR THE REMOVAL OF CASTINGS FROM CHILL MOULDS

[75] Inventor: Magnus Gustav Georg Tiberg, Hallefors, Sweden

[73] Assignee: Ingenjorsfirman R. Ohrnell AB, Karlstad, Sweden

[21] Appl. No.: 738,398

[22] Filed: Nov. 3, 1976

[30] Foreign Application Priority Data

Nov. 3, 1975 Germany ..... 2549225

[51] Int. Cl.[2] ..... B22D 29/00; B66C 1/00

[52] U.S. Cl. ..... 164/405; 294/106; 164/406

[58] Field of Search ..... 164/405, 406, 407, 408, 164/401-404, 344; 294/86 A, 106

[56] References Cited

U.S. PATENT DOCUMENTS

| | | | |
|---|---|---|---|
| 2,017,385 | 10/1935 | Anderson | 164/405 |
| 2,063,656 | 12/1936 | Bigler | 164/407 X |
| 2,117,311 | 5/1938 | Gathmann | 164/406 |

*Primary Examiner*—Robert D. Baldwin
*Assistant Examiner*—John S. Brown

[57] ABSTRACT

The present invention relates to a device for the removal of castings from chill moulds. The device comprises a body provided with controllable gripping means for the chill mould and controlling gripping means for the casting and ramming means provided to create blows against the chill mould in order to loosen the same from the casting. The body is provided to be suspended by hoisting means.

2 Claims, 10 Drawing Figures

DEVICE FOR THE REMOVAL OF CASTINGS FROM CHILL MOULDS

The present invention relates to a device for the removal of castings from chill moulds.

It is an object of the present invention to provide a device, by means of which castings can be removed from chilll moulds by means of a common hoist or a traverse crane.

It is another object of the invention to provide a device of the kind mentioned, by means of which also very strongly adhering castings can be removed without other means than the one mentioned being necessary.

The device according to the invention is characterized by a body, provided to be suspended in a hoist means and comprising controllable gripping organs provided to hold at least one chill mould, and controllable gripping organs provided to hold at least one casting, and ramming means provided to create blows against the chill mould in order to loosen the same from the casting.

Figure 7:
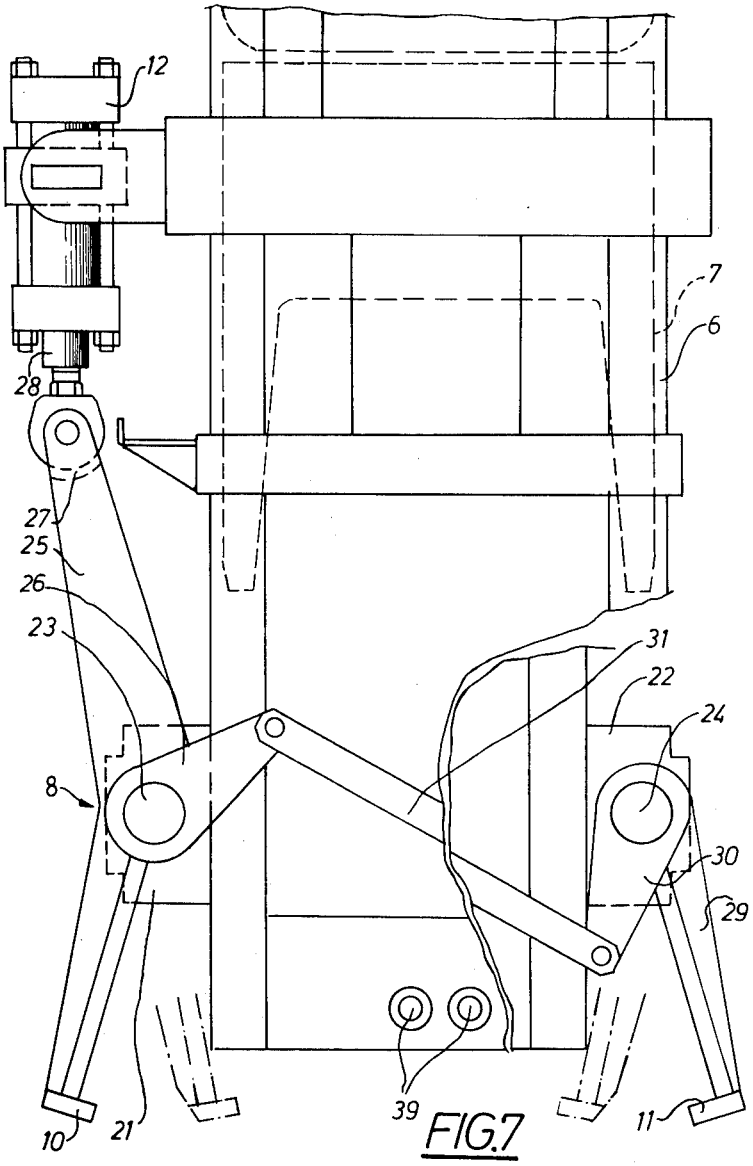
Figure 8:
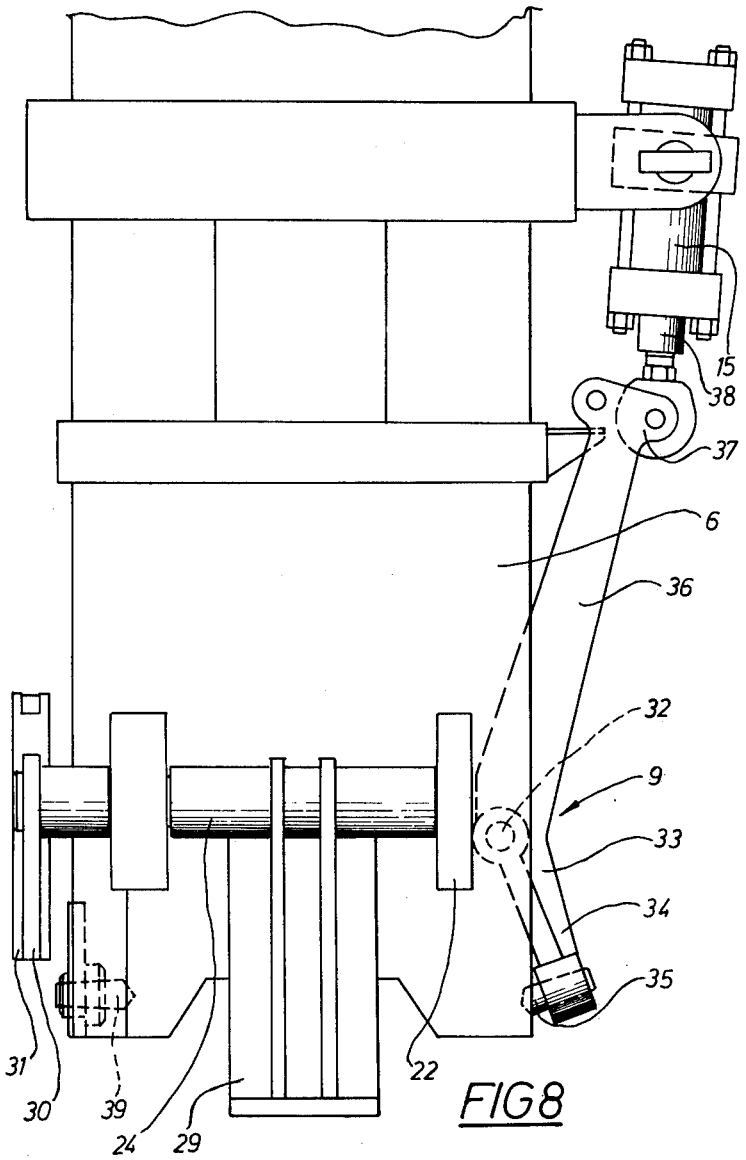
Figure 9:
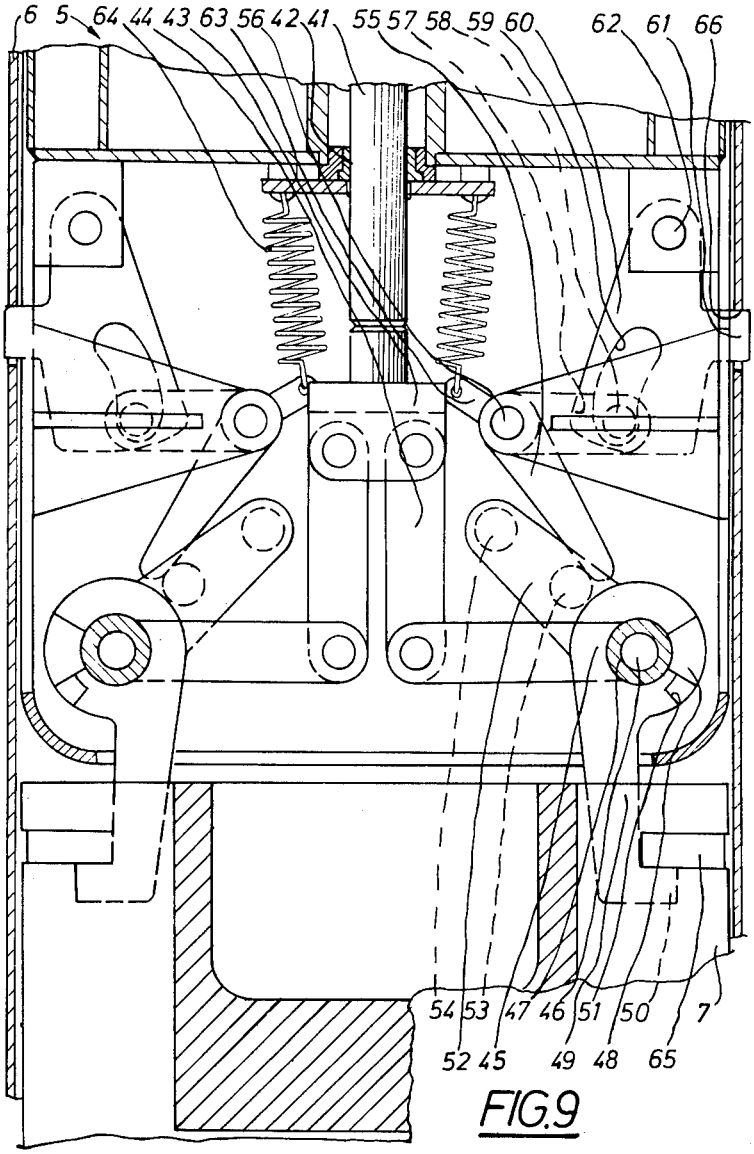
Figure 10:
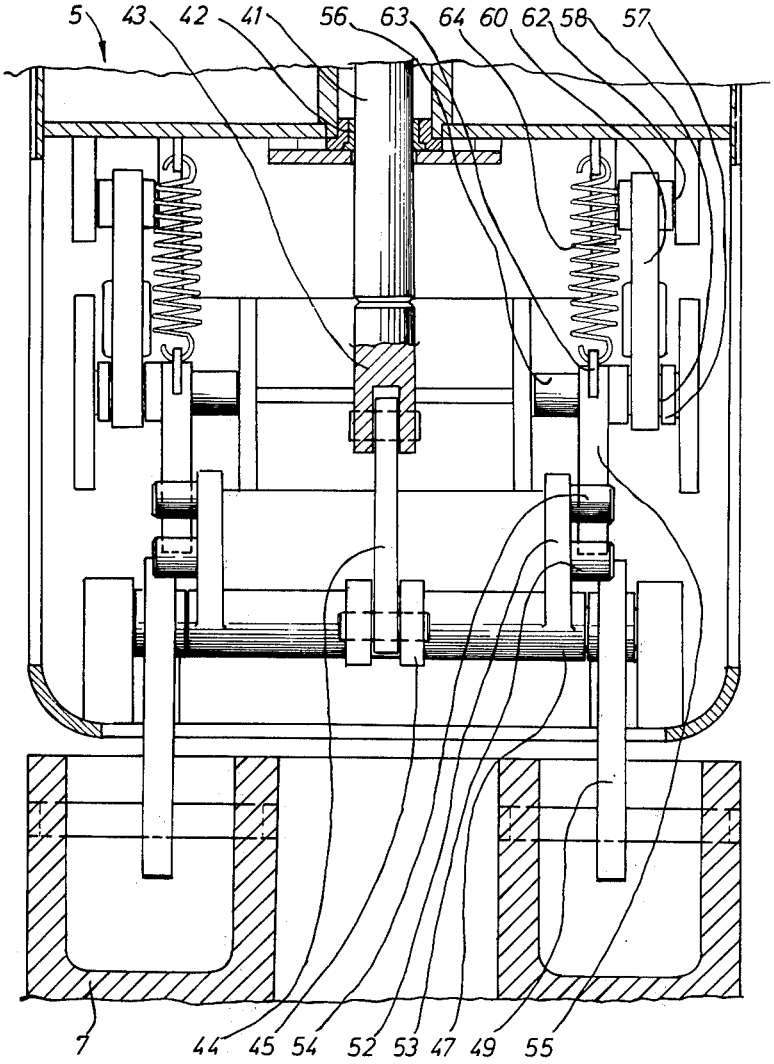

An embodiment of the invention is illustrated in the accompanying drawings. In the drawings FIG. 1 is a partly broken and schematic view of the device according to the invention in working condition, FIGS. 2 to 6 illustrate broken views of the device corresponding FIG. 1, and showing the same in different steps of work, however on a smaller scale, FIG. 7 is a partial view of the lower portion of the device, FIG. 8 is a corresponding partial view, but seen at right angle to the view illustrated in FIG. 7, FIG. 9 is a view of a central cross section through the device exhibiting a mechanism belonging to the same, and FIG. 10 is partial view at right angle to the cross section of FIG. 9.

Figure 1:
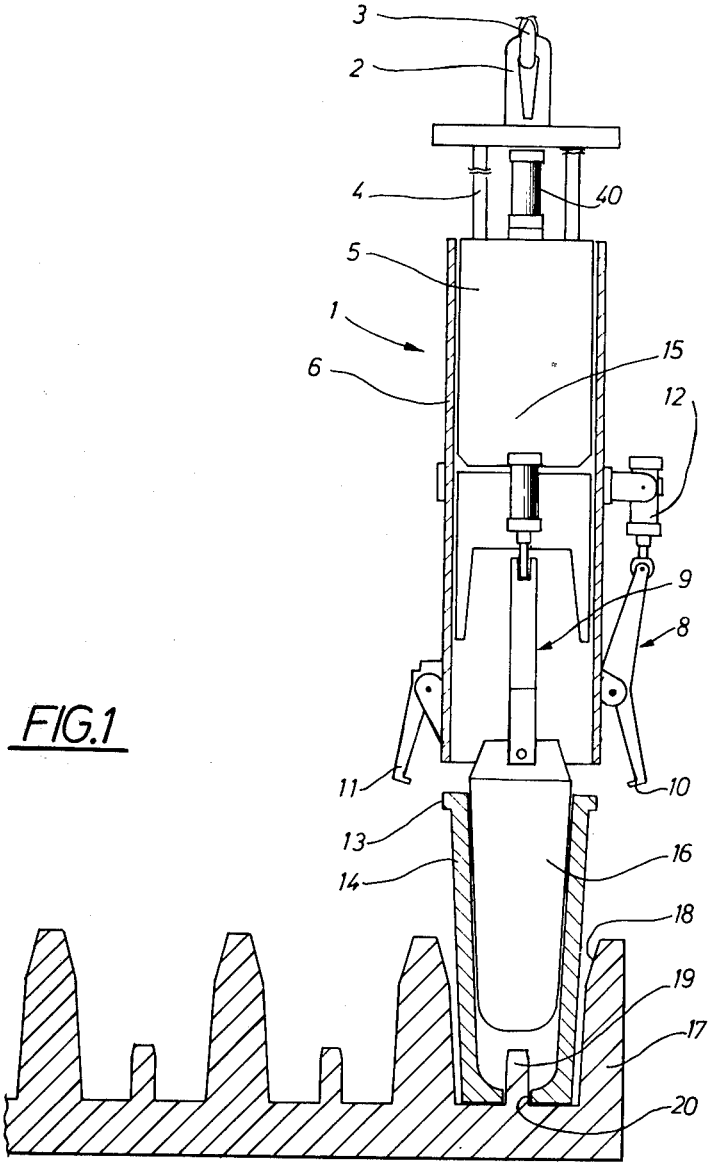

According to the somewhat schematic view of FIG. 1 the device 1 according to the invention is provided with an eye 2 for the suspension in a lifting hook 3, which hook by means of a steel wire or a chain, not shown, is suspended by a hoist or a traverse crane, by means of which the device 1 can be lifted and lowered. Two bars 4 project from a yoke connected with the lifting eye 2 and support a housing 5 for the mechanism. By means of hoisting means, which will be described more in detail in connection with FIG. 9, the mechanism housing 5 supports for one thing a frame 6, which shapes a sleeve-like outer wall of the device, and for another thing a ram 7.

The frame 6 supports two catching mechanisms, viz. for one part a chill mould tong 8 and for another part a casting tong 9. Hooks 10 and 11, which are operated by means of a power cylinder 12, can be made to hook on the edge 13 of a chill mould 14 and attach the same to the chill mould tong 8. The latter one is described more in detail in connection with FIG. 7. The casting tong 9, the design of which is more in detail evident from FIG. 8, is mounted on the frame 6 in the same manner as the chill mould tong 8. Said tong 9 is operated by means of a power cylinder 15, which likewise is attached to the frame 6, said power cylinder because of reasons connected with the drawing is in FIG. 1 shown free in front of the sectioned frame 6. The casting tong 9, which, as distinguished from the chill mould tong 8, is single sided, is designed in such a way that by co-operating with two pins on the opposed side of the frame 6 it can grip a casting 16 in the chill mould 14.

Figure 4:
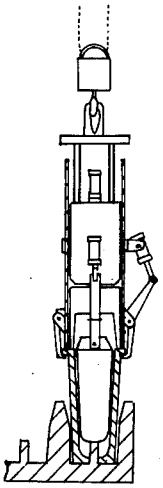
Figure 5:
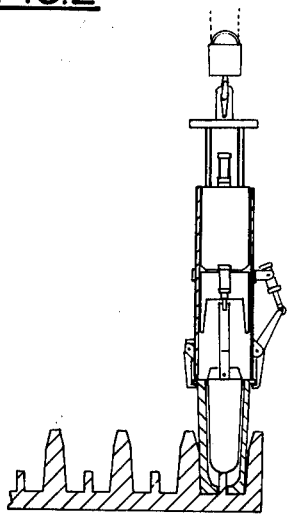
Figure 6:
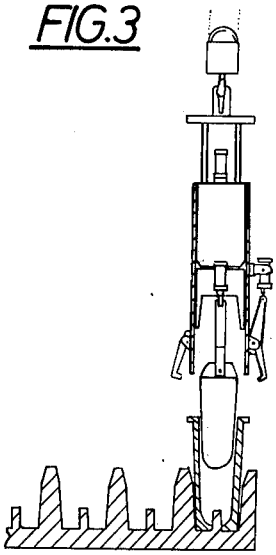

It is further evident from FIG. 4 that a stand 17 is provided in order to receive the chill mould 14, said stand exhibiting cavities surrounded by lateral walls 18, and each one of said cavities exhibiting central studs 19. In the chill mould there is a hole 20 corresponding to said stud.

The details described in connection with FIG. 1 are also evidennt from the FIGS. 2 to 5, in which they appear in different working positions, however on a reduced scale.

The chill mould tong 8 is shown in FIG. 7. FIG. 7 also shows a side elevational view of the lower portion of the frame 6, the right side of which, as seen in the drawing, having been displaced inwards towards the centre for the reason of space. Block bearings 21 and 22 with shafts 23 and 24 respectively are provided on each side of the frame 6. The shaft 23 supports for the one thing a double-armed level 25 and for another thing a single-armed lever 26. The lower end of the double-armed level 25 exhibits the previously mentioned hook 10, and the opposite lever arm exhibits at its extern end a hole 27, in which a piston rod 28 of the power cylinder 12 is journalled. The shaft 24 supports two single-armed levers, of which one, 29, supports the previously mentioned hook 11, while the other one supports a link 31, which connects the lever arms 30 and 26. Due to the lever arms 26 and 30 pointing upwards and downwards respectively, the movements of the levers 25 and 29 will take place in opposite directions by the simultaneous rotation of the shafts 23 and 24 caused by the link 31, so that the hooks 10 and 11 will simultaneously move inwards towards the centre of the frame, said hooks moving in outwards direction, when the movement takes place in the opposite direction. Said movement is brought about by projection and retraction respectively of the piston rod is brought about by projection and retraction respectively of the piston rod of the pivotably journalled piston cylinder 12 actuating the upper arm of the lever 25.

A side elevational view of the casting tong 9 is shown in FIG. 8. This tong exhibits a double-armed lever 33, which is journalled on a shaft 32 in the frame 6, the downwards pointing arm of said lever exhibiting a pin 35, the end of which points in inwards direction, and the upwards pointing arm of said lever exhibiting an eye 37, by means of which the lever arm is connected with the piston rod 38 of the pivotably journalled power cylinder 15. The inside of the frame 6 exhibits two pins 39 located in an opposite position relative to the one of the pin 35.

Parts of the mechanism of the chill mould tong 8 are also shown in FIG. 9, as can be seen in the lower portion of the figure.

As was mentioned in connection with FIG. 1, the device according to the invention comprises three principal units separated from each other, viz. the mechanism housing 5 suspended in the lifting hook, the frame 6 provided with the chill mould tong and the casting tong, and the ram 7. In order to bring about this separable assembling, the mechanism housing 5 exhibits means, which is evident from the FIGS. 9 and 10. In FIG. 9 the mounting of the mechanism housing on its place in the frame 6 is shown in a cross sectional view, while this frame 6 is not illustrated in the cross sectional view at right angle to FIG. 6, which is shown in FIG. 10.

A piston rod projects from the power cylinder 40 provided on the mechanism housing, the bar 41 being connected with this piston rod, and this bar thus can be upwards and downwards displaced by said power cylinder. The bar 41 is journalled in a sleeve 42, which is located in the mechanism housing and supports a yoke 43. Two links 44 are journalled in the yoke, and these links in their turn are journalled each one on its lever arm 45, which projects from a sleeve 47, which is journalled on a shaft 46, said sleeve 47 supporting a dog 48. Each shaft 46 further supports two lever arms 49, which are mounted outside of the ends of the sleeve, and which exhibit a hook-shaped end 50. Each one of the four lever arms 49 exhibit a notch 51, which cooperates with the corresponding dog 48, but which have a longer peripherical extension than the dog mentioned.

Each one of the sleeves 47 support two lever arms 52 with projecting pin-shaped pivots 53 and 54, which are located inside the move range of further lever arms 55, which are journalled on shafts 56. Each one of the four lever arms 55 together with each one its lever arm 57 form a bell crank. Each lever arm 57 exhibits a pin 58, which engages a pawl 60 provided with a catch tooth 61, said pawl being located in a groove 59. The four pawls 60 are journalled on four shafts 62, which like also the shafts 56 are supported by different brackets in the mechanism housing. In should also be mentioned that a third lever arm 63 is connected with the double-armed lever 53, 57. This lever arm 63 constitutes the point of attachment of one end of a tension spring 64, of which the other end is attached to the mechanism housing.

Figure 2:
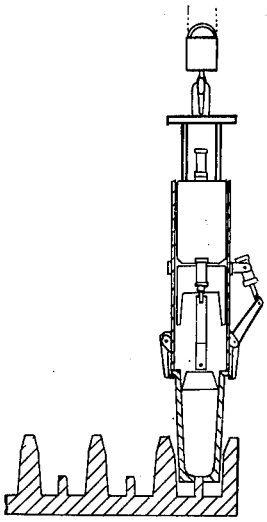
Figure 3:
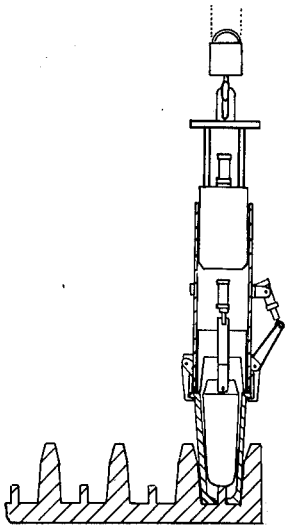

Thus, on one hand the four lever arms 49 with their hooks 50 and on the other hand the four catch teeth 61 project out of the mechanism housing 5. In this connection the hooks 50 cooperate with projecting ledges 65, which belong to the ram, so that this ram is supported by means of the hooks 50 and the ledges 65. The catch teeth 61, on their side engage holes 66 in the frame 6 so that this frame is supported by said mechanism housing which in its turn is supported by the hoisting means. The device funtions in the following manner:

The chill mould 14 is during the casting process located in a special stand, not shown, where it remains during the solidifying phase of the casting. After the solidification has taken place, and a top piece of the chill mould has been removed, the chill mould 14 together with the casting 16 is transferred to the stand 17, which is shown in the FIGS. 1 to 6. For the transfer to the stand the whole device will be lowered by means of the hoisting means mentioned, the hooks of which are indicated with 3, so that the frame 6 rests with its lower edge on the chill mould. Thereafter the power cylinder 12 is operated so that its piston rod 28 is forced outwards moving the upper portion of the lever 25 in counterclockwise direction, as seen in the FIG. 7. The hook 10 will thereby be pivoted inwards towards the centre of the frame 6 and brings with it the link 31, so that also the lever arm 30 will be pivoted on account of the different directions of the lever arms 26 and 30, but clockwise. This results in the lever arms 29 with the hook 11 being pivoted in direction towards the centre of the frame 6 and hook on to the edge 13 on the side opposed to the hook 10. The chill mould is now hooked by both hooks on to the frame 6, which in its turn by means of the catch teeth 61 is suspended in the mechanism housing 5 supported by the hoisting means, and now the chill mould 14 with the casting 16 can be lifted up and be transferred to the stand 17, as is shown in FIG. 2. When the casting is relatively loosely sitting in the chill mould, it will be set free by the stud 19, which during the lowering down to the stand 17 through the hole 20 in the chill mould 14 strikes against the bottom of the casting, so that, when the device is lowered still further, the chill mould will sink with its bottom to the stand, as is shown in FIG. 3.

However, as a rule the casting adheres too tightly to the chill mould. Therefore it is necessary to loosen the chill mould by means of blows from the casting resting on the stud 19. This takes place by actuating the power cylinder 40 in such a manner that the bar 41 (FIG. 9, 10) will be drawn in upwards direction. Thereby the sleeves 47 by means of the yoke 43, the link 44, and the lever arms 45 will be rotated, so that the dogs 48 will move in downwards direction. At the same time the lever arms 52 swing in outwards direction away from each other, whereby in the first place the pins 53 and during the continued movement the pins 54 will contact the lever arms 55, which results in an upwards pivoting of the lever arms. In this connection the pins 58 move in the corresponding grooves 59, which results in an inwards pivoting of the pawls 60, so that their catch teeth 61 will be retracted and loose their contact with the frame 6. Simultaneously the tension springs 64 will be tensioned by the lever arms 63. The retraction of the catch teeth 61 mentioned above in the first place does not signify that the frame 6 and the mechanism housing 5 will be displaced against each other, as the last mentioned housing 5 is suspended by the hoisting means and the frame 6 is resting on the chill mould 14.

In connection with the retraction of the catch teeth 61 the dogs 48 will reach the end of the notches 51, whereby the lever arms 49, which are journalled in idling mounting on the shaft 46, will be brought to pivot in inwards direction. This gradually results in the hook shaped projections 50 loosing the contact with the respective ledges 65. Thereby the ram will fall down and with its lower downwards projecting edge portions will strike the chill mould with strong impact. It is assumed that the chill mould thereby gets separated from the casting and with its bottom sinks down on the stand 17 into the position shown in FIG. 3. Thereby the frame 6 is carried along in the movement, because the chill mould tong still is hooked on. This is made possible due to the fact that the frame 6 is set free from the mechanism housing 5. By maintaining the casting tong hooked on during the working step mentioned, the risk that the chill mould and the casting, which rest on the stud 19, will tilt over is eliminated.

After the ram 7 has fallen down, it must again be connected with the mechanism housing, and it will be carried out by lowering down the housing mentioned by means of the hoisting means of the hoisting means and under continued actuation of the power cylinder 40, so that the lever arms 49 still occupy their inwards pivoted position. In the position illustrated in FIG. 4 the mechanism housing 5 and the ram 7 have again occupied their original position relative to each other, and the bar 41 will now by means of the power cylinder 40 be displaced in downwards direction. Thereby the sleeves 47 will rotate, and when the clearance in the notches 51 has been occupied, the dogs 48 will pivot the lever arms 49 in outwards direction, so that the hooks 40 again hook on to the ledges 65. Simultaneously the lever arms 52 will be pivoted in downwards inwards direction, so that the pins 54 and 53 will move away from the lever arm 55. However, said pins will be prevented from pivoting, because the hooks 61 impede the pivoting out of the pawls 60, when they contact the wall of the frame 6, which is displaced relative to the mechanism housing 5. Therefore a play arises between the pins 53, 54 and the corresponding lever arms 55.

When, as already has been described, the piston rod of the power cylinder 40 has again been brought down to its low position, the mechanism housing 5 by means of the hoisting means will be displaced in upwards direction until the catch teeth 61 reach the holes 66 in the wall of the frame 6. The pawls 60 are now free and can pivot outwards, and this is actuated via the double-armed levers 55, 57 by the stretched tension springs 64. If the chill mould and the casting should not have separated by means of the first stroke, the position according to FIG. 2 will again be occupied, and the chill mould can be subjected to further strokes, until the chill mould and the casting are set free from each other in which situation after the last lift of the ram 7 the position according to FIG. 5 will have been occupied. The next working step now involves the disengagement of the chill mould tong, and this is carried out by operation of the power cylinder 12 in connection with the hooking on of the casting tong 9 by actuation of the power cylinder 15. This operation signifies that the piston rod 38 will be forced out of the cylinder causing a pivoting of the lever arms 36 in clockwise direction, as seen in the FIG. 8, so that the lever arm 34 with the pin 53 will pivot in inwards direction. Thereby the pins 39, possibly in connection with a slight additional pivoting of the suspension means, will be pressed against the casting, which thus will be clamped between these pins and the pin 35. By means of lifting up the whole device, it is possible to lift the casting and carry it away. After cleaning the chill mould, it can be transported back to the casting station again by hooking on the chill mould tong to it.

As it evident from the above, the operation of the device takes place by lifting and lowering the same by means of the lifting means and by actuating the three power cylinders 12, 15 and 40. The power cylinders are suitably of the pneumatic type for control by compressed air, and therefore air hoses for connecting the device with a control panel is necessary. This control panel is suitably arranged in connection with the control panel for the hoisting means. The control panel can be equipped with some kind of locking means, which impedes the chill mould or the casting from getting separated from the device, and also impedes the parts of the device to get separated from each other, when it is lifted up. Under practical working conditions the cabin of a hoist or a traverse will as a rule be equipped with the controlling organs mentioned, which by means of hoses with couplings are connected to the air cylinders. By disconnecting the hoses and disengagement of the device from the hook 3, the hoisting means can be used for other purposes than for carrying the device according to the invention. When the device is needed, it is very simple to connect it to the hoisting means. By that an already available hoisting means can at low cost be adapted for the handling of castings and chill moulds. The control can of course also be arranged in another manner than by using pneumatic cylinders, as for example by means of hydraulics or electric motors.

I claim:

1. Device for the removal of castings from chill moulds, comprising a main body portion adapted to be suspended from hoisting means, a frame releasably connected to said body by connecting means, first controllable gripping means provided to releasably hold the chill mould and second controllable gripping means provided to releasably hold the casting, both of said gripping means being carried by the frame, a ram releasably connected to the frame holding means for the ram adapted to hold the ram at a distance above the chill mould when the mold is held by said first gripping means, power means provided to actuate the connection means in order to release the frame from the main body and to actuate the holding means in order to release the ram to effect an impact of same against the chill mould.

2. Device according to claim 1, in which controlling means are provided to bring the power means first to actuate the connecting means and release the frame from the main body and subsequently to actuate the holding means and release the ram, said controlling means comprising a bar connected with the power means, a link system connecting the bar to a number of lever arms, which are arranged by displacement of the bar to cause a pressure against the connecting means for the frame in a releasing direction against the bias of resilient means, which lever arms further are adapted to disconnect the holding means from the ram after development of a clearance between the lever arms and the holding means the clearance being such as to permit the lever arms to cause sufficient movement of the connecting means that the frame is released from the main body before the holding means is completely disconnected from the ram.

* * * * *